United States Patent [19]

Pine

[11] Patent Number: 4,989,914

[45] Date of Patent: Feb. 5, 1991

[54] RECLINER CHAIR WITH MECHANISM PERMITTING PROXIMITY OF UPPER END OF CHAIR BACK TO ROOM WALL

[75] Inventor: James J. Pine, Tupelo, Miss.

[73] Assignee: Action Industries, Inc., Tupelo, Miss.

[21] Appl. No.: 260,696

[22] Filed: Oct. 21, 1988

[51] Int. Cl.[5] ..... A47C 1/02

[52] U.S. Cl. ..... 297/85; 297/232

[58] Field of Search ..... 297/68, 69, 83–85, 297/232, 317, 322, 327, 349

[56] References Cited

U.S. PATENT DOCUMENTS

| | | | |
|---|---|---|---|
| 3,608,958 | 9/1971 | Knabusch | 297/69 |
| 3,891,267 | 6/1975 | Taylor | 297/349 X |
| 4,071,275 | 1/1978 | Rogers, Jr. | 297/85 |
| 4,337,977 | 7/1982 | Rogers, Jr. et al. | 297/85 |
| 4,350,387 | 9/1982 | Rogers, Jr. | 297/85 |
| 4,365,836 | 12/1982 | Jackson et al. | 297/68 X |
| 4,531,778 | 7/1985 | Rogers . | |
| 4,740,031 | 4/1988 | Rogers, Jr. | 297/85 |

*Primary Examiner*—Peter R. Brown

*Attorney, Agent, or Firm*—Cushman, Darby & Cushman

[57] ABSTRACT

A mechanism for a wall proximity-type of recliner chair, in which the chair-back reclining and erecting action is separate from the ottoman thrusting and retracting action, in which the forward-upward travel of the upholstered seat and arm frame unit as the chair back reclines feels as smooth as if it were produced by support wheels riding up an inclined ramp (although no wheels and ramp are used, thus avoiding the potential problem of a debris-obstructed ramp). The back end chair movement is synchronized by travel linkage to provide the desired upward and forward translation. Further, the locking linkage function and driving linkage function are provided by the same linkages. The mechanism can also be used in a modular sofa having a reclining unit, or in an armless chair, as the mechanism need not rise into a chair arm while the back is reclined and erected or the ottoman is thrust or retracted.

7 Claims, 5 Drawing Sheets

50
130
208
210
204
96
116
236
118
68
72
238
240
62
140
60
126
122
128
4B
196
142
66
70
94
256
254
258
180
4A
184
186
188
190

RECLINER CHAIR WITH MECHANISM PERMITTING PROXIMITY OF UPPER END OF CHAIR BACK TO ROOM WALL

BACKGROUND OF THE INVENTION

The present invention relates to motion chairs and particularly to a recliner chair of the type in which the mechanism carries the upholstered seat and arm frame, together with the upholstered chair back forwards relative to the chair base as the chair back is reclined, so that the chair need not be positioned far from a wall, or bodily displaced outwards from a wall, so that when the user wishes to recline, the upper end of the chair back, in reclining, will not intersect the wall.

The mechanism for the chair of the present invention is presently known by the assignee as the Action 3300 Wall Saver mechanism. Although this mechanism, having 24 links per side, has two more links per side than the mechanism it replaces at Action Industries, Inc., it easily provides four inches or more of additional forward travel upon reclining, provides greater smoothness of operation, and permits a wider latitude of design possibilities, so far as the finished, upholstered chair is concerned.

Two prior U.S. patents known to the present inventor show chairs having mechanisms which bear some similarity to the mechanism of the present invention:

Rogers, U.S. Pat. No. 4,350,387, issued Sept. 21, 1982 discloses a driving linkage which includes link 84 which drives back to link 82, which drives link 87, which drives the ottoman link 62. This mechanism further includes a lock in which the link 92 works in combination with the link 10, through pivots 89 and 94. In the mechanism which is disclosed in this reference, the ottoman cannot be thrust and retracted independently of reclining the chair back.

Rogers U.S. Pat. No. 4,531,778, issued July 30, 1985 discloses a mechanism in which, similarly to the present invention, the ottoman can be thrust and retracted separately from reclining the chair back. In this Rogers mechanism, the ottoman drive link 100 is hooked onto link 56, which works up front on pivot 101. The handle lock linkage, which maintains the linkage closed is shown in the Rogers patent at 154,152. The mechanism would function without the lock, but would not stay closed as reliably without it. In mechanisms of this type, which use wheels rolling in tracks, if all is going well, the support is superior, and the glide gives a very smooth and reassuring feeling. However, if and when lint, a staple, a wood flake or a similar obstruction gets into the track, the wheel or wheels encounter it and produce a bumpy, jarring ride, and the mechanism can be prevented from operating properly.

SUMMARY OF THE INVENTION

It is an object of the invention to provide a mechanism for a wall proximity-type of recliner chair, in which the chair-back reclining and erecting action is separate from the ottoman thrusting and retracting action, in which the forward-upward travel of the upholstered seat and arm frame unit as the chair back reclines feels a smooth as if it were produced by support wheels riding up an inclined ramp as in Rogers, U.S. Pat. No. 4,531,778 (although no wheels and ramp are used, thus avoiding the potential problem of a debris-obstructed ramp). The back end chair movement is synchronized by travel linkage to provide the desired upward and forward translation. Further, the locking linkage function and driving linkage function are provided by the same linkages. The mechanism can also be used in a modular sofa having a reclining unit, or in an armless chair, as the mechanism need not rise into a chair arm while the back is reclined and erected or the ottoman is thrust or retracted.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIG. 6 is a perspective view of a sofa one end seating unit of which, having an arm on only one side, is provided with a motion chair mechanism in accordance with the present invention.

DETAILED DESCRIPTION

Figure 1:
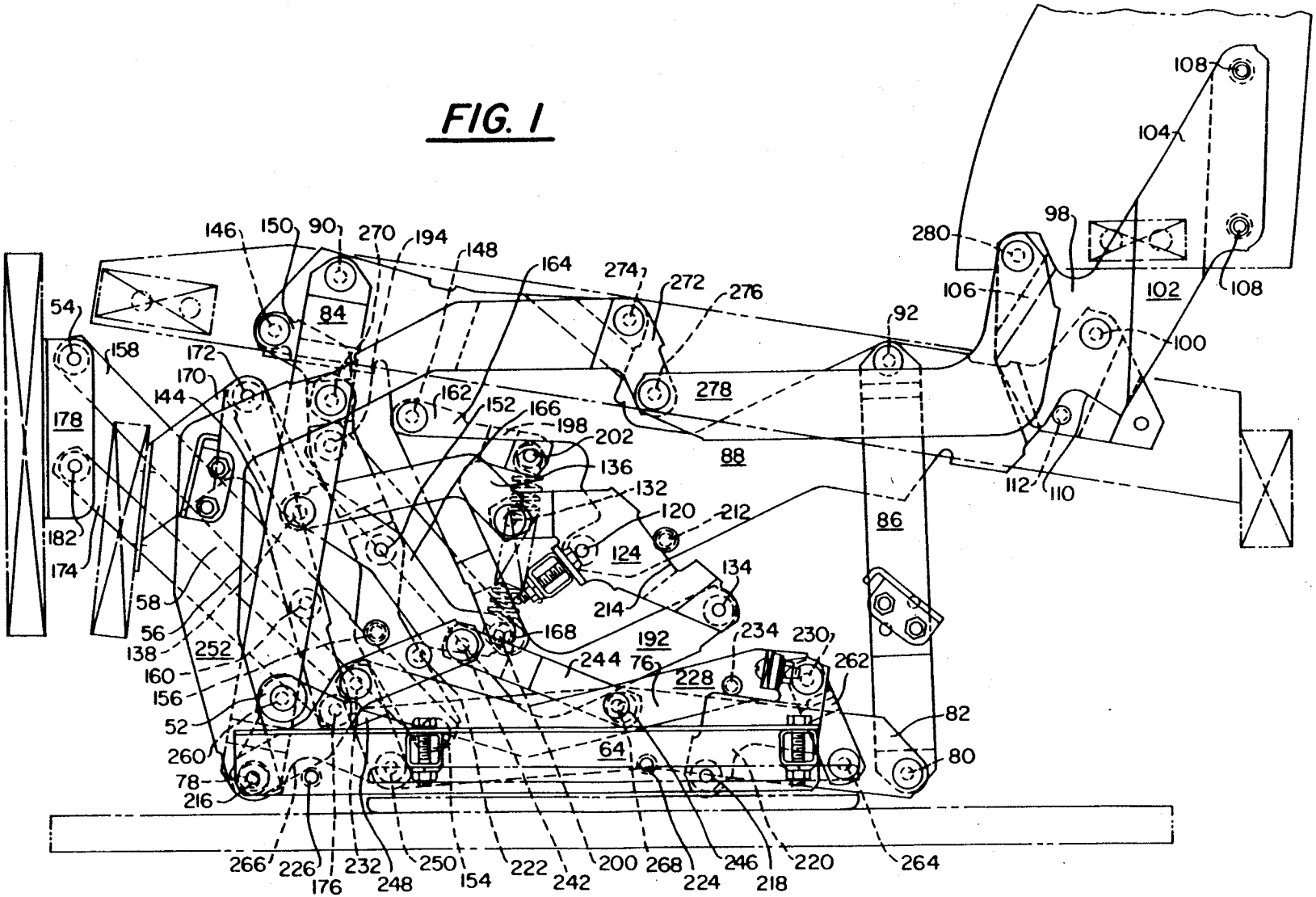
FIG. 1 is a fragmentary longitudinal sectional view of the mechanism mounted on a chair swivel base, the inner side of the handle-side linkage being illustrated in a fully erect, ottoman stowed position (and the non-handle side linkage, not shown, being a mirror image of the illustrated handle-side linkage)

The chair 10 includes a base 12 on which is mounted a mechanism 14, to which are secured an upholstered back 16, an upholstered seat and arm frame unit 18, a primary ottoman or footrest 20 and a secondary ottoman or legrest 22. The base, back, seat and arm frame and ottomans depicted are exemplary and may be modified substantially in structure and appearance and yet cooperate with the mechanism 14 to provide useful chair 10. (For instance, the foregoing may be elements of one seat of a sofa, with or without none, one or two arms.)

In the preferred embodiment, the chair 10 is both a wall proximity-type recliner and a swivel-type recliner, meaning that it is designed so that it can be located with the top end of its back 16 close to a wall of a room, yet be able to swivel about a vertical axis 24 located centrally of the base 12, and be reclined, without having the upper end of the back interferingly engage the room wall.

In the instance depicted, the base 12 is a conventional one. It includes a horizontal plate 26 which, to give some appreciation for typical scale, may be about two feet in diameter and about five-eighths of an inch thick. On the underside of the plate 26 near its outer perimeter are provided a plurality of glide buttons or feet 28. Centrally on top of the plate 26 is mounted the stationary plate 30 of a conventional swivel unit 32. The unit 32 further includes a rotary plate 34 supported and journalled (by conventional ball bearings) on the stationary plate 30. The unit 32 is held together at a vertical pivot joint 36 provided on the axis 24. In the instance depicted, the rotary plate 34 of the swivel unit 32 is square, so that it has four corner areas, which are provided with respective vertical-axis openings 38. Similarly, the four corner areas are provided with vertical-axis openings 40 through which bolts 42 are installed vertically downwards into conventional non-rotatable nut units mounted in respective vertical holes in the base plate 26.

The mechanism 14 may be made of conventional materials, e.g. stamped, cut, drilled, punched and/or bent steel plate, nut and bolt assemblies, washers, bushings, rivets, pins, tubing and springs using conventional forming and assembly techniques. With the exception of some stops and an operating handle, which are preferably made of synthetic plastic resin, such as nylon, and wood, respectively, substantially all of the mechanism 14 may be made of steel. Some or all of the mechanism 14 may be painted matte black, in order to render it less obtrusive, and to offer some protection against surface oxidation. Conventional lubricants can be used on its movable joints. The preferred appearance of the mechanism is as illustrated in the drawings. In some instances, the shapes of some regions of links are dictated by the need to provide sufficient metal to permit the location of a joint or other feature at a particular place, surrounded with enough metal to provide adequate strength, while providing profiles and bends that permit the various parts to move, without interference, in relation to one another as the chair is operated. Also, in some instances, the profiles of links include features that are mere artifacts of how the links were laid-out on the plate material from which they were punched, e.g. for maximizing the use of material without waste, while minimizing scrap and needless punching operations.

In general, the mechanism 14 includes a left side linkage 44 and a right side linkage 46. These side linkages are mirror images of one another and many of their parts are identical as used (i.e., the flat parts, stops, joints and the like), and the others are identical as cut from plate, but become mirror image by being bent in mirror-image fashion. In some cases, the mirror image quality of corresponding parts results simply from the reversed spatial orientation of the corresponding parts as assembled to provide the mechanism 14. (By arbitrary convention, the terms "left" and "right" are used from the vantage point of a chair occupant.)

The mechanism 14 further includes a plurality of transversally extending members, generally indicated by numerals 48, which interconnect corresponding structures on the side linkages 44, 46 for coordinating movement of corresponding parts of the left and right side linkages.

A link-by-link description of the mechanism 14 and a detailed description of its operation will be given hereinbelow; however, the following overview will first be provided:

The mechanism 14 provides a handle 50 which, when rotated to the rear, causes raising and thrusting the ottoman, and which, when rotated forwards, causes lowering and stowing of the legrests. The chair back is reclined by the occupant's "pushing-off" the arms of the seat and arm frame unit while leaning back on the chair back. Because of a stop provided at 52, reclining of the chair back can only be accomplished when the ottoman is in a thrust or nearly-fully thrust condition. In other words, the ottoman is handle-operated, whereas the back is lean back and push on the arms-operated (when the ottoman is in a thrust condition). The stop 52 is economically provided because it is integrated in structure with the thrusting and reclining structure, with a minimum of additional structure. The chair back must be erected, by shifting one's weight forwards and off one's back towards one's bottom, before the ottoman can be substantially retracted. However, to the chair user, the ottoman-thrusting and chair back-reclining operation seems to flow continuously in sequence, as does the ottoman-stowing and chair back-erecting operation. In part, this is due to how the linkage shifts the combined center of gravity of the chair and occupant during operation. As the ottoman is thrust, the point 54 at the top-rear of the primary ottoman moves forwards and upwards in an upwardly convex arc. At the same time, the seat and arm frame unit 18 and the chair back 16 move forwardly and tilt rearwardly as a whole (i.e., without any change in the position or angle of the chair back relative to the seat and arm frame unit). The tilting is accomplished by lowering the rear of the seat and arm frame unit and the bottom of the chair back, together, without substantially raising the front of the seat and arm frame unit. Whether or not and to what extent the chair back can be reclined depends on the existence and amount of space between the fronts of the stops 52 and the rear edges 56 of links 58 placed in generally erect, blocking relation in front of the stops 52. Lastly, as the chair back is reclined, the points 78 at the bottom-front of chair-supporting portion of the mechanism move forwards and upwards along respective substantially straight lines. In the presently preferred embodiment, this point moves forwards about five inches and up about one and a half inches as the chair back goes from being fully erect to being fully reclined. Corresponding movement is provided at the rear. (As the ottoman is thrust, the chair in the region of the bottom of the chair back moves forwards about four inches and down about an inch and a half, in the preferred embodiment. It is the combined movements as the ottoman is thrust and the chair back is reclined that keeps the combined chair/occupant center of gravity near the swivel axis 24 and permits the chair back 16 to be of adequate height yet not have its top strike the wall as the chair is reclined. Of course, particularly where the chair back is wide, e.g. with a wing-back style of upholstered unit, the user will want to station the base 12 somewhat out from the room wall, so that the wings will clear the wall as the chair is swiveled while the chair back is upright.)

Hereinbelow, a link-by-link description of the mechanism 14 will be provided. For ease in description, often a description of the structure on one side linkage will be provided, with the understanding that it is duplicated in mirror image on the other side linkage.

Each side linkage includes a horizontally extending longitudinal base rail 60, shown being an inverted L-shaped channel member with an upper, medially-directed horizontal flange 62 and, at its lateral edge, a depending vertical flange 64. Forward and rear nut and bolt assemblies 66, 68 installed vertically through the horizontal flange 62 mount the base rails 60 of the left and right side linkages 44, 46 to the opposite ends of square tube transversally extending forward and rear base bars 70, 72. By preference, the rear fasteners 68 are located very close to the rear of the base rails 60 (which, in the presently preferred embodiment, are each about one foot in length), but the front fasteners 66 are installed about one-quarter of the way back from the front ends of the base rails 60, so that the base rails extend further forwards of, than to the rear of, the vertical swivel axis 24. The lower edge 74 of the vertical flange 64 lies about one-third of an inch above the upper surface of the base plate 26. The length and relative position of the base rails 60 is such that, if the front ends of the base rails 60 are located about one-half inch inside the radially outer perimeter of the of the base plate 26, the rear ends would need to be extended about four inches to cross that perimeter. (Of course, the base plate 26 could be of greater or lesser diameter than the one which is illustrated.)

The structure which is provided on each side linkage 44, 46 in the region 76 supports the remainder of the mechanism 14 from the mechanism base 60, 70, 72, mounts the stops 52, and provides the desired pattern of motion as the chair back is reclined and erected, but, while the ottoman is being thrust and retracted, no movement of the mechanism 14 in the regions 76 comes into play, with the exception of pivoting of certain links about the forward and rear transverse, horizontal-axis pivot joints 78 and 80. Although neither of these joints is provided directly on the flange 62 (in the preferred embodiment they are located about an inch outboard of the flange 62), they do not move in relation to the flange 62 during ottoman thrusting and retraction, so the structure 76 may be correctly thought of as being a means for providing and maintaining the stationary support for the pivot joints 78, 80 as the ottoman is thrust and retracted. The structure 76 will be described in further detail below. Suffice it to state for the present, that the pivot joints 78, 80 are provided in the forward and rear end portions of a flat, horizontally, longitudinally-extending long lower link 82 which is disposed in a vertical plane located, in the preferred embodiment, about an inch outboard of and (in the erect condition of the chair back), with its profile generally superimposed upon that of the respective vertical flange 64.

The forward pivot joint 78 pivotally mounts the lower end of a generally vertical support link 84. In use, the upper end of this link will pivot from about ten degrees behind being vertical to about ten degrees in front of being vertical as the ottoman is being fully thrust.

The rear pivot joint 80 pivotally mounts the lower end of a generally vertical support link 86. In use, this link will pivot from being approximately vertical to being disposed at approximately a forty-five degree angle with the upper end located forwardly of the lower end.

Each side mechanism further includes a main upper, generally horizontally, longitudinally-extending long link 88. Whereas the lower main link 82 is flat, in the preferred embodiment both the link 88 and the links 84, 86 have bends in them at several places, e.g. for clearing other structure as the mechanism is operated.

The upper end of the front support link 84 is pivotally secured to the upper long link 88 by a transverse, horizontal-axis pivot joint 90, located in the upper front corner region of the upper long link 88.

The upper end of the rear support link 86 is pivotally secured to the upper long link 88 by a transverse, horizontal-axis pivot joint 92, located about three-quarters of the way back along the link 88.

Accordingly, the members 82, 84, 86, 88 are connected to provide a parallelogram, four-bar linkage, by the pivot joints 78, 80.

Towards its front and towards its rear, lower edge portions of the upper long link 88 are turned outwards along respective generally horizontal but slightly upwardly-forwardly inclined bend lines to provide generally horizontal flanges 94, 96 provided with generally vertical openings through which nut and bolt assemblies or other fasteners may be installed for mounting the seat and arm frame unit on the mechanism 14.

Behind the pivot joint 92 and above the flange 96, the upper long link 88 is provided, at its upper rear corner for mounting a reverse J-shaped (modified L-shaped) chair back-mounting link 98, by means of a transverse, horizontal-axis pivot joint 100. The pivot joint 100 is located in the "U" portion 102 of the "J", nearer the rear, longer leg 104 than the forward, shorter leg 106. The long leg 104 is provided near its upper end with threaded openings 108 (drilled openings augmented by non-rotative, press-fit, internally-threaded nut-like fittings), which permit the chair back to be secured, near its lower end, to the upright rear leg 104 of the modified L-shaped link 98 of the mechanism 14.

The lower edge of the link 98 is notched at 110 and the upper long link 88 is provided with a medially horizontally projecting pin 112, which is received in the slot 110 and is usually spaced from its defining edge, except that as the chair back is reclined, at the desired extreme of full recline, the pin 112 strikes the rear edge of the slot to provide a positive stop against further reclining movement.

The rear support links 86 are shown provided approximately midway along their height with openings by means of which respective nut and bolt assemblies 114 secure bent-down flanges 116 at opposite ends of a transverse horizontally extending flat bar 118 to the two links, thus providing one of the transverse bracing, coordinating members 48 mentioned hereinabove.

The upper long link 88 is, very approximately, reclining Y-shaped, with the pivot joint 90 being located on the upper one of the two forwardly projecting arms of the "Y", and the pivot joint 100 at the far end of the single leg. The remaining arm projects forwardly and downwardly and at its forward end is provided with a transverse, horizontal-axis pivot joint 120. The lower arm is substantially shorter than the upper arm, so the pivot joint 120 is located substantially further back than the pivot joint 90 on the upper arm. In fact, when the ottoman is fully retracted, the pivot joint 120 is located above and about midway between the longitudinal positions of the vertical axis 24 of the swivel, and the tubular cross-bar 70. The opening provided in the upholstery of the seat and arm frame unit for egress of the torque tube 122 on which the operating handle 50 is mounted lies on an axis on which the pivot joints 120 of the left and right side mechanisms 44, 46 are mounted.

The pivot joint 120 mounts an intermediate portion of a generally straight (but bent out of plane) link 124, which, by being rotated and translated forwardly as the torque tube is rotated in one angular sense, acts to raise and thrust the ottoman, and by being rotated and translated rearwardly as the torque tube is rotated in the opposite angular sense, acts to lower and stow the ottoman.

The torque tube 122 includes a main, straight portion, and, near the handle end, an integral extension which is bent immediately outboard of the respective link 88 and bent back about two inches further out, to provide an oblique portion 128, and a handle-attachment portion 130, which is located on the axis of the pivot joints 120, as aforesaid.

The link 124 has two opposite ends, both provided with respective transverse, horizontal axis pivot joints 132, 134. When the ottoman is fully retracted and stowed, the link 124 is spatially oriented approximately horizontally, with its pivot joint 132 forwards and located above its pivot joint 134. Raising and thrusting of the ottoman requires rotating the handle 50 rearwardly through about one hundred-twenty degrees, so that when the ottoman is in its fully thrust condition, the link 124 is spatially oriented with its pivot joint 134 forwards and located below it pivot joint 132.

A flat, hockey stick-shaped link 136 is provided (handle forwards, blade rearwards, arched upwards) with its "blade" end pivoted to the link 124 by the pivot joint 132 and its "handle" end pivoted to the front supporting link 84 at a level midway along the vertical extent of the link 84, by a transverse, horizontal-axis pivot joint. The inside of the elbow in the link 136 permits the link 136 to move down at the pivot joint 132 as the ottoman is being thrust, without coming into interfering relationship with the torque tube 122.

The torque tube 122 is secured to the links 124 of the left and right side linkages 44, 46, by means of nut and bolt assemblies 140 which bolt through the straight main portion 126 of the torque tube 122, and also through medially-directed finger flanges 142 bent from the links 124 beside the pivot joints 120.

The ottoman, as aforesaid, preferably includes a primary ottoman 20, and a secondary ottoman 22. Either could be omitted, either may be connected to the side linkages by break-away and/or yielding structures as have become used in the industry for preventing a child from being trapped between the rear of the ottoman and the front of the chair below the seat as the ottoman is being retracted. Likewise, the chair 10 may be upholstered so as to have a web of upholstery fabric or the like hanging in a catenary between the secondary ottoman and the front of the chair below the seat so as to prevent children from playing in or anyone from routinely stepping into the region between the rear of the raised, thrust secondary ottoman and the front of the chair below the seat, in order to reduce the chance that anyone will become trapped in this region as the ottoman is being retracted.

The ottoman mounts onto pantograph-type ottoman mounting linkage portions 144 of the side linkages 44, 46.

Each pantograph linkage portion 144 is shown being based on the front, lower part of the respective main upper link 88 by a forward, upper transverse, horizontal-axis pivot joint 146, and a lower, rear transverse horizontal-axis pivot joint 148.

(The following description is of the pantograph linkage portions extended, with the ottoman in a thrust condition.) The pivot joint 146 is shown mounting the rear end of a first rear bar 150 which is uppermost in its rear segment, has an intermediate transverse, horizontal-axis pivot joint 152 and then is lowermost forwardly of that pivot joint. The first bar 150 is provided at its front end with a transverse, horizontal-axis pivot joint 154. Between the pivot joints 152 and 154, the first bar 150 is provided with a horizontal, medially directed pin 156 which engages respective edges of two other links to limit extension and retraction of the pantograph, as will be apparent from comparing the respective views. The pantograph 144 further includes a first front link 158 which has its rear segment lowermost, is connected to the forward end of the first rear link 150 by the pivot joint 154, has the aforementioned pivot joint 54 provided at its front end, and crosses from being lowermost to being uppermost in the pantograph, at an intermediate transverse, horizontal-axis pivot joint 160. The pantograph linkage portion is shown further including a series of four links, namely the leg 162 of a V-shaped link 164 (having the pivot joint 148 located at its base), a second link 166 (having its rear end connected by a transverse, horizontal-axis pivot joint 168 to the forward end of the link leg 162, the joint 168 being hidden from outboard view by a later-mentioned link), a third link 170 (having its rear end connected by a transverse, horizontal-axis pivot joint 172 to the forward end of the link 166) and a fourth link 174 (having its rear end connected by a transverse, horizontal-axis pivot joint 176 to the forward end of the link 170). Intermediate sites on the links 150 and 166 are pivotally interconnected, scissors-fashion, by the pivot joint 152, and intermediate sites on the links 170 and 158 are pivotally interconnected, scissors fashion, by the pivot joint 160. The parallelogram defined on three sides by the links 158, 170 and 174 is completed at its front end by the longitudinal-vertical plane flange 178 of a L-shaped channel bracket 180 which is pivotally mounted to the front ends of links 158 and 174 by the pivot joint 54 and a further transverse, horizontal-axis pivot joint 182. The bracket 180 further includes a medially-directed flange 184, and it is to this flange, as replicated on the left and right side linkages, that the primary ottoman 20 is mounted, e.g. by appropriate fasteners installed through the openings 186. The links 170 are preferably V-shaped, apex rearwards, with the upper leg bent medially, in two stages, to provide medially-directed flanges 188 to which the secondary ottoman is mounted, e.g. by using appropriate fasteners installed through the openings 190.

Each pantograph linkage system is driven for extension and retraction by a hockey stick-shaped link 192 having its rear, lower "blade" end pivotally secured to the crank link 124 by the pivot joint 134, and its forward, upper "handle" end pivotally secured to a location on the first rear link 150 intermediate the pivot joints 146 and 152 by a transverse, horizontal-axis pivot joint 194. Each pantograph is kept "tight" and retraction is assisted, by a tensioned coil spring 196 which is secured between a laterally-directed, lower forward pin 200 located on the link 192 on its "handle" segment, near where the "handle" segment adjoins its "blade" segment, and a laterally-directed upper, rear pin 202 located on the rear/lower leg 198 of the V-shaped link 164. When the ottoman if fully thrust, the spring 196 is in an only slightly tensioned condition. As the pantograph is being retracted, the spring 196 is stretched, reaching a maximum when the ottoman is about eighty percent fully retracted (e.g., in the preferred embodiment, when the handle 50 is pointing about straight up), and then recovering about half of its (about one-inch) stretch, as retraction is completed. The amount of stretch is, of course, governed by the proximity of the pins 200 and 202 to one another, as pulled towards on another by spring tension, during the movement of the various parts.

The offset outer end portion 130 of the torque tube 122 is shown provided with what amounts to an L-shaped bracket 204 having one leg 206 mounted thereto, e.g. by welding (or by a mechanical fastener such as one or more nut and bolt assemblies, not shown), and another leg 208, to which the handle 50 is mounted, e.g. by wood screws 210.

As the handle 50 is rotated forwards to retract the ottoman, retraction is further positively stopped by providing a medially-directed pin 212 on the lower leg of the Y-shaped upper long link 88, positioned behind the torque tube 122 (e.g. by about an inch and a half) to engage the rear edge of the crank link 124 at 214.

The mechanism 14 structure which comes into play for controlling reclining and erection of the chair back, and for preventing (or restricting) reclining of the chair back when the legrest is in a retracted condition will now be described in further detail. (Spatial orientation is given assuming the back to be fully reclined, except as otherwise noted.)

On its outboard side, the depending vertical flange 64 of each longitudinal rail 60 of the mechanism base is provided respectively near its front end and its rear end with transverse, horizontal-axis pivot joints 216 and 218.

The rear pivot joint 218 mounts the lower end of a short, flat S-shaped link 220, and the front pivot joint 216 mounts the lower ends of two links, the further-inboard one of which is a slightly S-shaped link 222. Extremes of movement of the mechanism 14 upon reclining and erection of the chair back are, at least in part, provided in the preferred embodiment respectively by a laterally-directed stop pin 224 mounted to the flange 64 about an inch forwardly of the pivot joint 218 for engagement with the forward edge of the link 220 below the lower "knee" of the latter, and a laterally-directed stop pin 226 mounted to the flange 64 about an inch rearwardly of the pivot joint 216 for engagement with the rear edge of the link 222 below the lower knee of the latter.

A fourth side of a parallelogram of links provided by the flange 64, and the support links 220 and 222, is provided by a secondary generally horizontal long link 228 which is pivotally secured to the upper end of the rear support link 220 by a transverse, horizontal-axis pivot joint 230, and to an intermediate height location on the front support link 222 by a transverse, horizontal-axis pivot joint 232.

Stopping of mechanism movement, and provision of added support, is further provided by a medially-directed pin 234 provided 586 on the link 228 about an inch and a half forwards of the pivot joint 230, at a location such that the pin 234 will engage on the front edge of the S-shaped link 220, above the lower knee, as the chair back become fully erect.

Below and forwardly of the pivot joint 230, the S-shaped link 220 is provided with a medially-bent finger flange 236. Nut and bolt assemblies 238 secure the flanges 236 of the left and right side linkages 44, 46 to opposite ends of a transverse bar 240 to provide a further one of the bracing, coordinating transverse members 48.

The upper end of each forward support link 222 is provided with a transverse, horizontal-axis pivot joint 242. A link 244 is provided and has its forward, upper end connected with the upper end of the front support link 222 via the pivot joint 242, whereas its lower, rear end is pivotally connected with an intermediate site on the long link 82 by a transverse, horizontal-axis pivot joint 246. Further restriction is placed on movement of the parallelogram 64, 220, 228, 222, by a short link 248 which has its forward end pivotally secured to an intermediate location on the secondary long link 228 forwardly of and below the pivot joint 232, by a transverse, horizontal-axis pivot joint 250, and which has its rear end pivotally secured to the front support link 222 by the pivot joint 232.

The other link which is pivotally secured to the flange 64 of the rail 60 by the pivot joint 216 is a forwardly and downwardly arched link 58, the lower end of which is so-secured. The link 58 arches concavely rearwardly around front of the plastic stop roller 52, so that its rear edge 56 is arranged to engage the roller 52 for preventing (or substantially restricting) reclining of the chair back until the legrest is fully raised and thrust.

The upper end of the link 58 is provided above a knee 252 to which is bolted at 254 a respective bent-end flange 256 of a transverse bar 258 provided with an L-shaped transverse cross-sectional shape for added stiffness. The bar 258 constitutes another of the aforementioned transverse bracing and coordinating members 48.

The stop roller 52 is rotatably mounted on a medially-directed axle 260 secured on the forward end of the long link 82, above the pivot joint 78.

Further coordination and control of the long link 82 in relation to the secondary long link 228 is provided at the rear by a short link 262 pivotally connected to the secondary long link 228 and to the rear support link 220 at a corner of the respective parallelogram, by the pivot joint 230, and to the long link 82, about an inch and a quarter forwardly of the pivot joint 80, by a transverse, horizontal-axis pivot joint 264. The structure 82, 228, 262, as connected by the described pivot joints is completed as a parallelogram linkage structure by the short front bar 248 pivotally secured at its upper and lower ends to the bars 228, 82, by the pivot joints 232, 250.

(The medially-directed pins 266, 268 located at intermediate sites on the links 222 and 228 optionally mount opposite ends of a tension coil spring (not shown) which is used, especially when the chair is provided with a heavy upper back, to help counterbalance the weight of the back, so that the user, as he or she is erecting the back from a reclining condition, will be aided by recovery of the stretched spring, which is stretched again the next time the back is reclined, by the user pressing back and down with his or her weight on the chair back.)

The arcuate link 58 is provided at its upper end with a horizontal, transverse-axis pivot joint 270 which mounts the forward end of a downwardly convex link 272 which has an intermediate, upper knee provided with a transverse, horizontal-axis pivot joint at 274, and a rear end provided with a transverse, horizontal-axis pivot joint 276. The pivot joint 274 connects the link 272 with the upper long link 88, at a location generally midway between the pivot joints 90 and 92, and the pivot joint 276 connects the lower, rear end of the arcuate link 272 with the forward end of a reclining, reversed L-shaped link 278, the generally vertically upwardly-directed short leg of which has its upper end pivotally secured to the upper end of the short leg 106 of the reversed J-shaped back-mounting link 98 by a transverse, horizontal-axis pivot joint 280.

When the legrest is in a fully retracted and stowed condition, the roller 52 is positioned snugly against the rear edge 56 of the arcuate link 58, the portion below the knee 252 of which is disposed in a generally vertical condition. As the legrest (or ottoman, a synonym) is raised and thrust, the support links 84 and 86 pivot forwards about the joints 78 and 80, thus carrying the link 88 longitudinally forwards and down at the rear, causing the link 58 to have its upper end pushed forwards due to forward translation of the pivot joint 270 (together with the structure 272, 278, 98, as a whole). Accordingly the link 58 is rotated away from the roller 52, so that a gap is created between the periphery of the roller 52 and the rear edge 56 of the now-tilted arcuate link 58. The lower part of link 58 which was vertical is now disposed at approximately a forty-five degree angle. As reclining of the chair back is begun, by the occupant's pushing the upper part of the chair back rearwards and down relative to the seat and arm frame unit, the lower part of link 58 is tilted further, as the movement of the elements of the structure 76 move the pivot point 78 upwards and forwards, and the chain of links 98, 278, 272 connected by pivot joints 280, 276 (and 274 to the link 88), act on the upper end of the arcuate link 58 by means of the pivotal connection 270. At this stage, the roller 52 remains spaced above and to the rear of the edge surface 56, which is oriented at about twenty-five degrees to horizontal, and the path of travel of the roller during chair back reclining carries the roller along parallel to the edge surface 56.

To summarize operation of the mechanism in the illustrated preferred embodiment

As the ottoman is thrust, point 54 at the top rear of the primary ottoman moves forwards and upwards in an upwardly convex arc. At the same time, the seat and arm frame unit, and the chair back, move forwardly and tilt rearwardly as a whole, without any change in the position or angle of the chair back relative to the seat and arm frame unit. The seat and arm frame unit and the bottom of the chair back lower, without the front of the seat and arm frame unit being substantially raised.

The stops 52 prevents the chair back from being reclined until the ottoman is in, or at least nearly in, its fully extended condition. Whether and to what extent the chair back can be reclined depends on the existence and the amount of space between the fronts of the stops 52 and the rear edges of the links 56 placed in generally erect, blocking relation in front of the stops 52.

The stops 52 are economically provided because they are integrated into the mechanism with the linkage portions which cause or permit the ottoman thrusting-/retraction and chair back erecting/reclining motion, needing a minimum of additional structure.

Although the ottoman can be thrust and retracted without thereby causing the chair back to be reclined or erected, the chair back must have been restored by the user to its fully erect condition before the ottoman can be substantially retracted from a fully extended condition.

Locking, for keeping the ottoman fully retracted and stowed, except when the crank means is intentionally operated, is caused due to the alignment of the points 134, 120 and 194 which is effected as the handle is fully rotated in the direction that retracts the ottoman.

As the chair back is being reclined, points 78 at the bottom-front of the seat and arm frame-supporting portion of the motion chair mechanism move forwards and upwards, along respective substantially straight lines, about five inches forwards and about 1.5 inches up, as the chair back moves from being fully erect to being fully reclined. In the region of the bottom of the chair back, the corresponding travel is about four inches forwards and about 1.5 inches down.

As the chair is operated from a stowed ottoman, erect back condition, to an extended ottoman, reclined back condition, in the preferred embodiment, the seat travels a total of about 12.5 inches forward relative to the base. The magnitude of this movement is due primarily to the tallness of the links 84, 86 and the nature of the parallelograms of the recline portions of the side linkages.

The chair can be compact in front to rear depth, because the mechanism can be compact in the closed-erect condition of the chair. The mechanism can be used in a chair which has small arms, (or has no arm on one or both sides, as in a recliner unit of a sofa in which the chair forms one seating unit of a plurality in series on the same base, or in a modular sofa), because the mechanism (except where the back attaches to it) does not extend substantially above the longitudinal side members of the seat, while erect, while operating and while in the extended-reclined condition.

Figure 2:
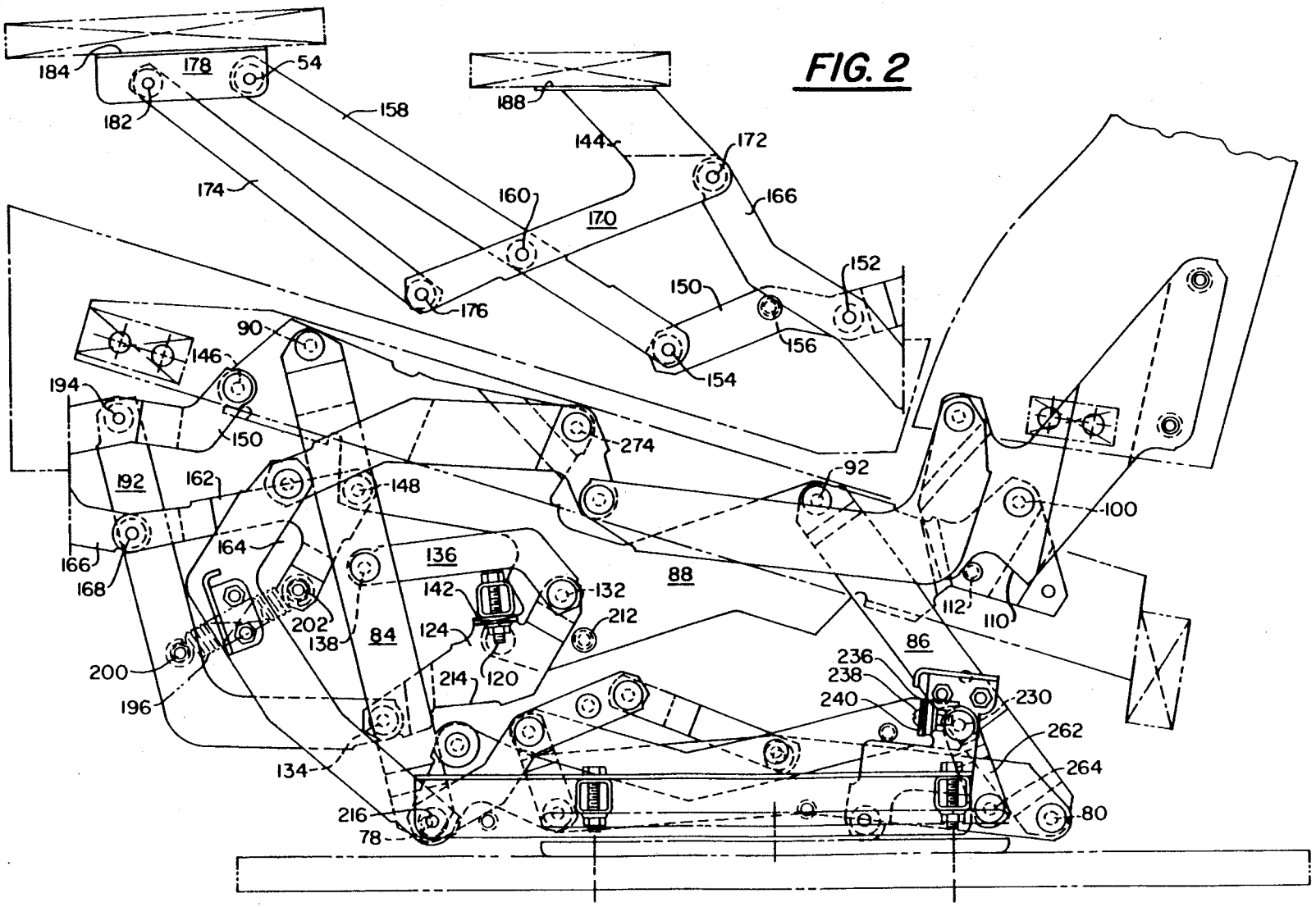
FIG. 2 is a fragmentary longitudinal sectional view of the mechanism mounted on a chair swivel base, the inner side of the handle-side linkage being illustrated in a TV position, the figure being broken at the chain-dot line which appears at the left of the lower portion and at the right of the upper portion, with a chain-dot connecting line.
Figure 3:
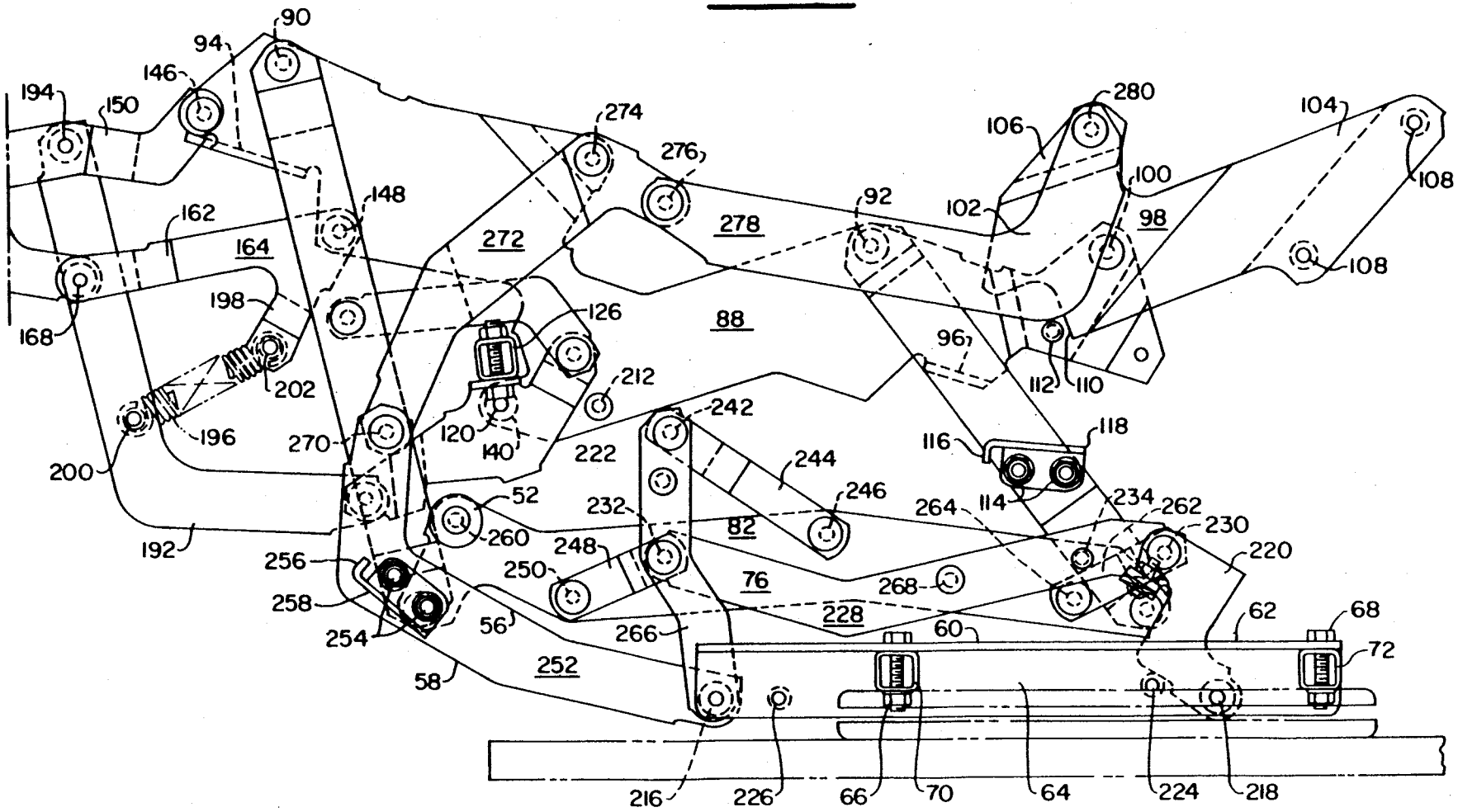
FIG. 3 is a fragmentary longitudinal sectional view of the mechanism mounted on a chair swivel base, the inner side of the handle-side linkage being illustrated in a fully-reclined position (with the ottoman-mounting pantograph that would appear substantially the same as in FIG. 2 being omitted at the chain-dot line which appears at the left in this figure)
Figures 4, 4A, 4B:
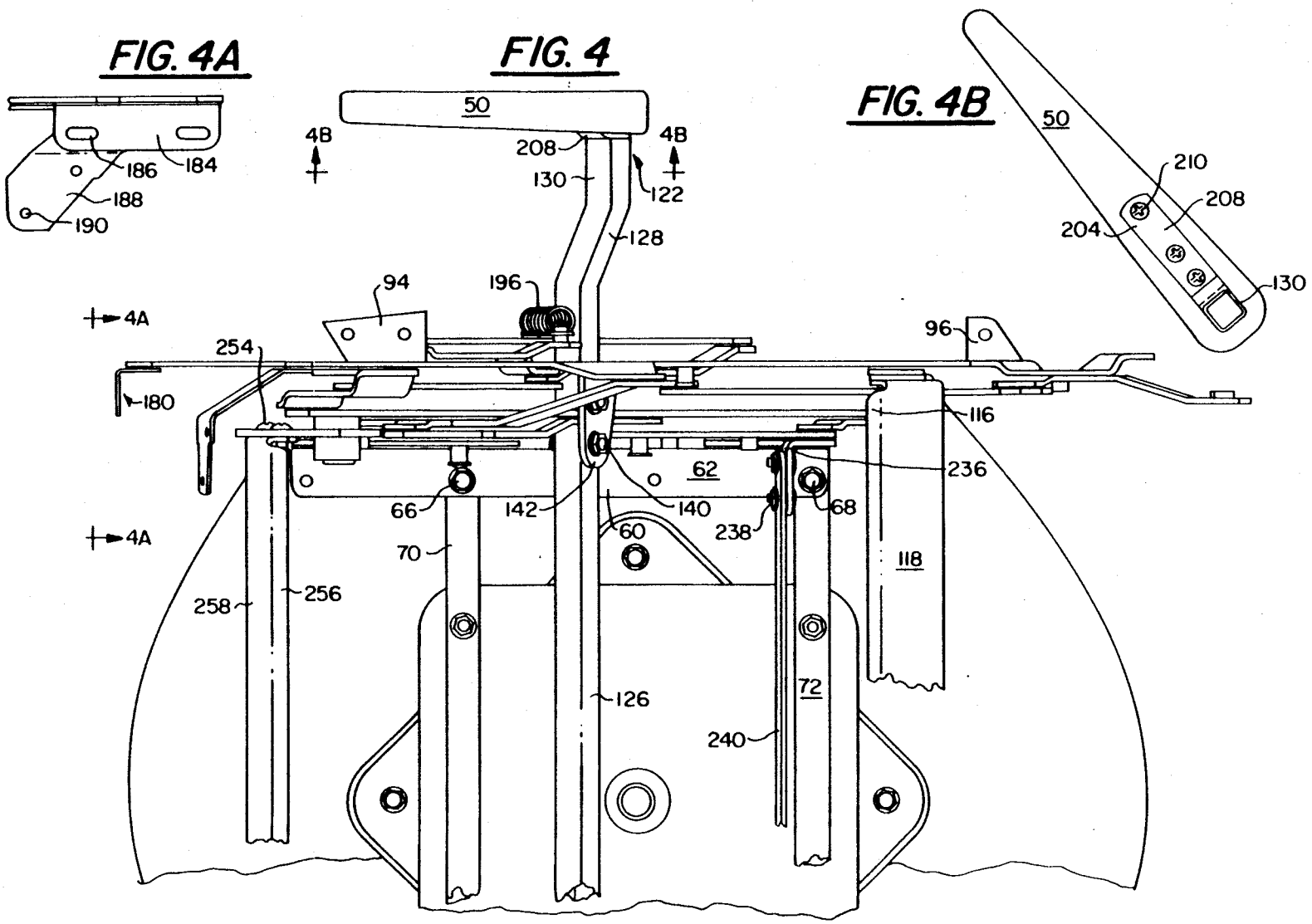
FIG. 4 is a fragmentary top plan view of the mechanism, mounted on chair swivel base, showing the mechanism it its closed condition, the handle-side linkage and its connections to transverse members of the mechanism being illustrated to a point somewhat past the longitudinal centerline of the chair.
FIG. 4A is a fragmentary front elevational view of the handle-side linkage on line A—A of FIG. 4, showing the ottoman-mounting flanges.
FIG. 4B is a fragmentary transverse cross-sectional view of the torque tube on line B—B of FIG. 4, showing the inner side of the operating handle.
Figure 5:
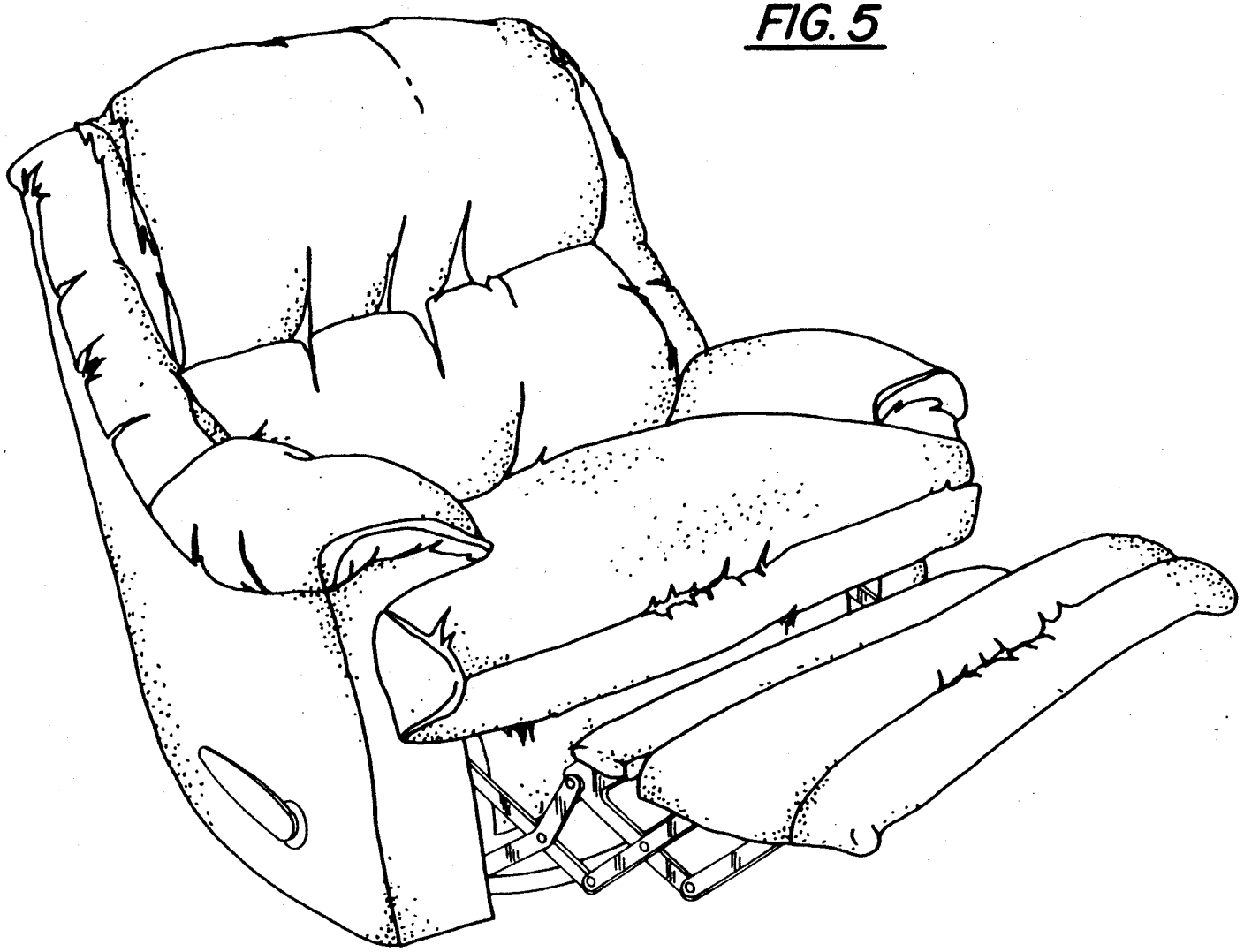
FIG. 5 a perspective view of a swivel-base, wall-proximity recliner chair provided with a mechanism embodying principles of the present invention, and shown in a TV position (back erect, ottoman raised and thrust).

In FIG. 6, a modular sofa 310 is shown comprising a plurality of seating units 312, 314, etc., disposed side-by-side in a series on a base 316. One end unit, 318, which has an arm 320 on one side, but is armless on the opposite side, is a recliner which is provided with a mechanism 322 as has been described hereinbefore as mechanism 14 in relation to FIGS. 1–5.

It should now be apparent that the recliner chair with mechanism permitting proximity of upper end of chair back to room wall as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A wall proximity-type of recliner chair, comprising:

a chair base adapted to be supported on a floor of a room near where the floor intersects a wall of the room;

an upholstered seat unit including a seat frame having left and right longitudinally extending seat frame elements rigidly interconnected by at least one transverse seat frame element, and a covering of upholstery providing a seat which has a transverse front edge, a transverse rear edge, a longitudinal left edge and a longitudinal right edge;

an upholstered back unit including a back frame having left and right longitudinally extending back frame elements rigidly interconnected by at least one transverse back frame element, and a covering of upholstery providing a back which, in an erect condition, has a transverse top edge, a transverse bottom edge, a longitudinal left edge and a longitudinal right edge;

an ottoman, comprising a primary ottoman having a transversally extending rigid frame element having a left end and a right end;

a motion chair mechanism, comprising:

a first plurality of interpivoted links organized into a generally longitudinally extending left side linkage;

a second plurality of interpivoted links organized into a generally longitudinally extending right side linkage;

each of said links being disposed generally on edge, and said left side linkage being substantially a mirror image of said right side linkage, so that each of said side linkages has a plurality of corresponding links, a plurality of corresponding pivot joints and a plurality of corresponding attachment points;

a plurality of transverse members rigidly connecting corresponding sites on said left side linkage with respective corresponding sites on said right side linkage so that operational movement of said side linkages is substantially fully coordinated;

means mounting said motion chair mechanism on said base;

said attachment points of said left and right side linkages including:

a plurality of first attachment points, located above said mounting means, by which corresponding first link means of said side linkages are secured to said seat frame, whereby said upholstered seat unit is mounted on said base;

a plurality of second attachment points located above said mounting means and towards the rear of said left and right side linkages, by which corresponding second link means of said side linkages are secured to said back frame near said lower edge of said back, so that said back is mounted to said base and said back, when erect, projects upwards from said upholstered seat unit from near said rear edge of said seat;

a plurality of third attachment points located above said mounting means, and towards the front of said left and right longitudinally extending seat frame elements and under said front edge of said seat, when said ottoman is in a fully retracted and stowed condition, by which said rigid frame element of said primary ottoman is secured to corresponding third link means of said side linkages;

said motion chair mechanism further including:

crank means connecting one of said transverse members of said motion chair mechanism, for rotating said one transverse member about its own transversally extending longitudinal axis, without translating said axis relative to said upholstered seat unit;

said third link means comprising left and right pantographic linkage systems operatively connecting with said one transverse member so that when said crank means is operated to rotate said one transverse member fully in one direction, said ottoman is raised and projected forwards from said fully retracted and stowed condition, to a fully projected condition in which it is available for supporting, off of the floor, the feet or the backs of the legs in the vicinity of the feet, of a user seated on the seat of the recliner chair, and so that when said crank means is operated to rotate said one transverse member fully in a direction opposite to said one direction, said ottoman is lowered and retracted from said fully projected condition to said retracted and stowed condition;

said first and second plurality of interpivoted links being so organized that as said crank means is rotated in said one direction, said ottoman moves forwardly and upwards in an arc, while said seat unit and back unit move forwardly and tilt rearwardly as a whole relative to said base, without causing any substantial change in position or angle of said back relative to said seat, and as said crank means is rotated in said opposite direction, said ottoman moves rearwardly and downwards along said arc, while said seat unit and back unit move rearwardly and tilt forwardly as a whole relative to said base, without causing any substantial change in position or angle of said back relative to said seat;

said first and second plurality of interpivoted links being so organized as to permit said crank means to be fully rotated in said one direction and in said opposite direction without thereby causing reclining or erection of said back relative to said seat;

an actuator, operatively connected with said crank means, and disposed for accessibility to a user seated in the recliner chair from externally of said recliner chair, for selectively rotating said crank means a selected amount in said one direction and in said opposite direction for thereby raising and thrusting, and for thereby lowering and retracting said ottoman by desired amounts;

said first and second plurality of interpivoted links being so organized as to permit said back to be reclined from an erect condition and erected from a reclined condition, relative to said seat, by action of a user seated on said seat:

pushing backwards on an upper region of said back while placing somewhat less of his or her weight downwards on said seat, for causing said back to become more reclined relative to said seat, while said seat unit and back unit travel forwards and upwards, as a unit, relative to said base, along an imaginary, substantially flat inclined plane which slopes forwardly upwards at an angle of less than forty-five degrees above horizontal, while rotating in a sense to lower said rear edge of said seat relative to said front edge of said seat, and leaning somewhat forwards so as to take some of his or her weight off of said upper region of said back while placing somewhat more of his or her weight downwards on said seat, for causing said back to become more erect relative to said seat, while said set unit and back unit travel rearwards and downwards, as a unit relative to said base, along said imaginary inclined plane, while rotating in a sense to raise said rear edge of said seat relative to said front edge of said seat said first and second plurality of interpivoted links including lock means which effectively bar movement of said second attachment points relative to said first attachment points unless and until said ottoman is either in or nearly in, said fully projected condition, but which effectively permit movement of said second attachment points relative to said first attachment points while said ottoman is either in or nearly in said fully projected condition, so that said back cannot be reclined unless said ottoman is already at least nearly fully projected and so that said ottoman cannot be substantially extended from said fully retracted and stowed condition unless said back is in said fully erect condition;

the sum of forward movement of said seat unit and said back unit relative to said base as said ottoman is moved from said fully retracted and stowed condition to said fully projected condition, and as said back is moved from said fully erect to said fully reclined condition being sufficient to prevent said upper edge of said back from moving substantially rearwards while reclining, whereby said recliner chair need not be moved substantially further away from a wall for use including reclining of said back than for use not including reclining of said back;

each said side linkage including a horizontally extending longitudinal base rail, comprising an inverted L-shaped channel member with an upper, medially directed horizontal flange and, at its lateral edge, a depending vertical flange; forward and rear nut and bolt assembles installed vertically through the horizontal flange mount the base rails of the left and right side linkages to opposite ends of a plurality of said transverse members;

each said side linkage further including first and second, forward and rear horizontal axis pivot joints respectively provided in forward and rear end portions of a flat, horizontally, longitudinally extending long lower main link which is disposed in a vertical plane located outboard of and, in the erect condition of the chair back, with its profile generally superimposed upon that of the respective said vertical flange;

each forward pivot joint pivotally mounting a lower end of a front generally vertical support link, an upper end of which link, in use, pivoting from about ten degrees behind being vertical to about ten degrees in front of being vertical as said ottoman is being fully thrust;

said rear pivot joint pivotally mounting a lower end of a rear generally vertical support link, which, in use, pivots from being approximately vertical to being disposed at approximately a forty-five degree angle with an upper end thereof located forwardly of said lower end thereof;

each side linkage further including a main upper, generally horizontally, longitudinally extending long link;

said upper end of each said front support link being pivotally secured to the respective said upper long link by a third transverse, horizontal-axis pivot joint, located in an upper front corner region of the respective upper long link;

said upper end of each said rear support link being pivotally secured to the respective said upper long link by a transverse, horizontal-axis twenty-ninth pivot joint, located about three-quarters of the way back along the respective said upper long link;

on each said side linkage, the lower main link, front support link, rear support link and upper main link being connected to provide a respective parallelogram, four-bar linkage, by said first and second pivot joints;

said first attachment points securing said seat frame to said upper long links;

each said upper long link being provided at an upper rear corner with a fourth transverse, horizontal axis pivot joint securing a respective reverse J-shaped chair back-mounting link to the respective upper long link;

said second attachment points securing said back frame to said reverse J-shaped back-mounting link;

each said fourth pivot joint being located in a U-portion of the respective reverse J-shaped link nearer a rear, longer leg thereof, than a forward, shorter leg thereof;

each said longer leg being provided near an upper end thereof with the respective said second attachment means;

each said upper long link being provided with a medially, horizontally projecting pin which is engageable, in use, with an edge of the respective said reverse J-shaped link for providing a positive stop against further reclining of the chair back unit to define an extreme of full recline for the chair back unit;

each said upper long link being approximately, reclining Y-shaped, with the respective said third pivot joint being located on an upper one of two forwardly projecting arms thereof, and the respective said fourth pivot joint at a rear end of a single rear leg thereof;

each said upper long link further including a lower said forwardly projecting arm which projects forwardly and downwardly and at a forward end thereof is provided with a transverse, horizontal-axis fifth pivot joint;

each said lower arm is substantially shorter than the respective said upper arm, so each fifth pivot joint is located substantially further back than the respective third pivot joint on the respective upper arm;

each said fifth pivot joint mounting an intermediate portion of a generally straight link, which, by being rotated and translated forwardly as said one transverse member is rotated in one angular sense, acts to raise and thrust the ottoman, and by being rotated and translated rearwardly as said one transverse member is rotated in the opposite angular sense, acts to lower and stow the ottoman;

said one transverse member being a torque tube comprising a main, straight portion, and, near a handle end to which said actuator is mounted as a handle, an integral extension which is bent immediately outboard of a respective upper long link, and bent back further out, to provide an oblique portion, and a handle-attachment portion, which is located on a common rotational axis of both fifth pivot joints;

each said generally straight link has two opposite ends, respectively provided with respective transverse, horizontal axis sixth and seventh pivot joints, disposed such that when the ottoman is fully retracted and stowed, each generally straight link is spatially oriented approximately horizontally, with its sixth pivot joint forwards and located above its seventh pivot joint;

raising and thrusting of the ottoman requiring rotating the handle rearwardly through about one hundred-twenty degrees, so that when the ottoman is in its fully thrust condition, each generally straight link is spatially oriented with its seventh pivot joint forwards and located below its sixth pivot joint;

each side linkage further including a flat, hockey stick-shaped link provided handle forwards, blade rearwards, arched upwards, with a blade end pivoted to the respective generally flat link by the respective sixth pivot joint and a handle end pivoted to the respective front support link at a level midway along the vertical extent of the respective front link support, by an eighth transverse, horizontal-axis pivot joint;

the inside of an elbow in each hockey stick-shaped link permitting the respective hockey stick-shaped link to move down at the respective sixth pivot joint as the ottoman is being thrust, without coming into interfering relationship with the torque tube;

the torque tube being secured to the generally flat links of the left and right side linkages;

said third attachment means of each side linkage mounting said ottoman to pantograph-type ottoman mounting linkage portions of said side linkages;

each pantograph linkage portion being based on a front, lower part of the respective upper main link by a forward, upper transverse, horizontal-axis ninth pivot joint, and a lower, rear transverse horizontal-axis pivot tenth joint;

each ninth pivot joint mounting a rear end of a respective first rear bar which is uppermost in a rear segment thereof, has an intermediate transverse, horizontal-axis eleventh pivot joint and then is lowermost forwardly of that eleventh pivot joint;

each first bar being provided at a front end thereof with a transverse, horizontal-axis twelfth pivot joint;

between the respective eleventh and twelfth pivot joints and each first bar being provided with a horizontal, medially directed pin which engages respective edges of two other links to limit extension and retraction of the respective linkage pantograph;

each pantographic linkage portion further including a first front link which has a rear segment lowermost, is connected to the forward end of the respective first rear link by the respective twelfth pivot joint, has a thirteenth transverse, horizontal axis pivot joint provided at a front end thereof, and crosses from being lowermost to being upper most in the respective pantographic linkage portion, at an intermediate transverse, horizontal-axis fourteenth pivot joint;

each pantographic linkage portion is shown further including a series of four links, namely a leg of a V-shaped link having the tenth pivot joint located at a base thereof, a second link having a rear end connected by a transverse, horizontal-axis fifteenth pivot joint to a forward end of said link leg, a third link having a rear end connected by a transverse, horizontal-axis sixteenth pivot joint to a forward end of said second link, and a fourth link having a rear end connected by a transverse, horizontal-axis sixteenth pivot joint to a forward end of said third link;

intermediate sites on the respective first rear bar and second link being pivotally interconnected, scissors-fashion, by the respective eleventh pivot joint, and intermediate sites on the respective third link and first front link being pivotally interconnected, scissors fashion, by the respective fourteenth pivot joint;

respective parallelograms defined on respective three sides by the respective first front, third and fourth links being completed at a respective front end by a longitudinal-vertical plane flange of a respective L-shaped channel bracket which is pivotally mounted to the front ends of respective first front and fourth links by the respective thirteenth pivot joints and a transverse, horizontal-axis seventeenth pivot joint;

each L-shaped channel bracket further including a medially directed flange to which said ottoman is mounted;

each pantographic linkage portion being driven for extension and retraction by a second hockey stick-shaped link having a rear, lower blade end pivotally secured to the respective said crank link by the respective said seventh pivot joint, and a forward, upper handle end pivotally secured to a location on the respective said first rear link intermediate the respective ninth and eleventh pivot joints by a transverse, horizontal-axis eighteenth pivot joint;

on an outboard side thereof, the depending vertical flange of each said longitudinal rail of the mechanism base is provided respectively near its front end and its rear end with transverse, horizontal-axis nineteenth and twentieth pivot joints;

each twentieth pivot joint mounts a lower end of a short, flat S-shaped link, and each nineteenth pivot joint mounts the lower ends of two links, the further-inboard one of which is a slightly S-shaped link;

a fourth side of respective parallelograms of links provided by the respective depending vertical flange, and the respective S-shaped and slightly S-shaped support links, is provided by a respective secondary generally horizontal long link which is pivotally secured to the upper end of the respective S-shaped link by a transverse, horizontal-axis twenty-first pivot joint, and to an intermediate height location on the respective slightly S-shaped link by a respective transverse, horizontal-axis twenty-second pivot joint;

the upper end of each slightly S-shaped link being provided with a transverse, horizontal-axis twenty-third pivot joint;

for each side linkage, a further link being provided and having a forward, upper end connected with the upper end of the respective slightly S-shaped link via the respective twenty-third pivot joint, whereas its lower, rear end is pivotally connected with an intermediate site on the respective said lower main link by a transverse, horizontal-axis twenty-fourth pivot joint;

another said link which is pivotally secured to said flange of each said base rail by the respective nineteenth pivot joints is a respective forwardly and downwardly arched link, a lower end of which is so-secured;

each said forwardly and downwardly arched link arches concavely rearwardly around front of a respective stop roller, so that a rear edge thereof is arranged to engage the respective stop roller for substantially restricting reclining of the chair back until the ottoman is fully raised and thrust;

each said stop roller being rotatably mounted on a medially directed axle secured on the forward end of the respective said lower main link, above the respective first pivot joint;

further coordination and control of each lower main link in relation to the respective secondary long link being provided at the rear by a respective short link pivotally connected to the respective secondary long link and to the respective s-shaped link at a corner of the respective parallelogram, by the respective twenty-first pivot joint, and to the respective lower main link, forwardly of the respective second pivot joint, by a transverse, horizontal-axis twenty-fourth pivot joint;

each structure comprising a respective said lower main link, secondary long link and short link, as connected by respective said pivot joints is completed as a parallelogram linkage structure by a respective short front bar pivotally secured at upper and lower ends thereof to the respective secondary long link and lower main link by the respective twenty-second pivot joint and a respective twenty-fifth transverse horizontal-axis pivot joint;

each said arcuate link is provided at its upper end with a horizontal, transverse-axis twenty-sixth pivot joint which mounts a forward end of a respective downwardly convex link which has an intermediate, upper knee provided with a transverse, horizontal-axis twenty-seventh pivot joint at, and a rear end provided with a transverse, horizontal-axis twenty-eighth pivot joint; each said twenty-seventh pivot joint connects the respective downwardly convex link with the respective upper main link, at a location generally midway between the respective third and twenty-ninth pivot joints, and the respective twenty-eighth pivot joint connects the lower, rear end of the respective downwardly convex link with the forward end of a reclining, reversed L-shaped link, a generally vertically upwardly directed short leg of which has its upper end pivotally secured to the upper end of the short leg of the respective reversed J-shaped back-mounting link by a respective transverse, horizontal-axis thirtieth pivot joint.

2. The recliner chair of claim 1, wherein:

said base includes a stationary, floor-engaging lower portion, an upper portion, and a rotary joint which mounts said upper portion on said lower portion for rotation about a substantially vertical axis; and said mounting means mounting said motion chair mechanism to said upper portion of said base, whereby said recliner chair, excepting said lower portion of said base, is rotatable on the floor, about said substantially vertical axis.

3. The recliner chair of claim 1, wherein;

said first and second plurality of interpivoted links are so organized as to have no portion thereof, located longitudinally between said front edge of said seat and where said second link means connect with said back unit at said second attachment points, extend substantially above said left and right longitudinally extending seat frame elements.

4. The recliner chair of claim 3, wherein:

said upholstered seat unit is armless at least one of the left and right edges of said seat.

5. The recliner chair of claim 4, wherein:

said upholstered seat unit, upholstered back unit, ottoman and motion chair mechanism are mounted on said base by said mounting means so as to provide only one of a plurality of serially side-by-side seating units on said base, there being no armrest between said one seating unit and another said seating unit on said base.

6. The recliner chair of claim 1, wherein:

said externally accessible actuator for said crank means is constituted by a handle disposed beside said seat unit.

7. The recliner chair of claim 6, wherein:

said upholstered seat unit further includes left and right upholstered arm frames rigidly secured to said left and right longitudinally extending seat frame elements and thereby providing, an upholstered seat and arm frame unit;

said handle being disposed outboard of an upholstered arm of said upholstered seat and arm frame unit.

* * * * *